US006314860B1

(12) United States Patent
Paulus

(10) Patent No.: US 6,314,860 B1
(45) Date of Patent: Nov. 13, 2001

(54) RAM CYLINDER PISTON STROKE STOP WITH INTEGRATED SPRING

(76) Inventor: Gregory Stanley Paulus, 1805 W. 4th Ave., Spokane, WA (US) 99204

( * ) Notice: Subject to any disclaimer, the term of this patent is extended or adjusted under 35 U.S.C. 154(b) by 0 days.

(21) Appl. No.: 09/590,024

(22) Filed: Jun. 7, 2000

(51) Int. Cl.[7] ..... E15B 15/26
(52) U.S. Cl. ..... 92/18; 92/23
(58) Field of Search ..... 92/15, 18, 19, 92/23

(56) References Cited

U.S. PATENT DOCUMENTS 2,397,516 * 4/1946 Stewart ..... 188/67
3,008,772 * 11/1961 Helsel, Sr. ..... 305/146
3,682,327 * 8/1972 Winne ..... 414/741
3,818,804 * 6/1974 Miller ..... 92/23
4,155,433 * 5/1979 Porter ..... 92/21 MR

OTHER PUBLICATIONS

Photograph of a piston stroke stop that has been in public use or on sale prior to Jun. 7, 1999.
Photograph of piston stroke stops with riveted springs, on sale prior to Jun. 7, 1999.

* cited by examiner

*Primary Examiner*—John E. Ryznic
(74) *Attorney, Agent, or Firm*—Wells, St. John, Roberts, Gregory & Matkin P.S.

(57) ABSTRACT

A ram cylinder piston stroke stop is disclosed, including a pair of opposed piston shaft gripping members each formed in an extruded shape along an axis with an integral extruded axially open spring end receiving socket. A spring includes opposed ends that are engaged within the spring end receiving sockets.

16 Claims, 4 Drawing Sheets

RAM CYLINDER PISTON STROKE STOP WITH INTEGRATED SPRING

TECHNICAL FIELD

The present invention relates to limiting the stroke of a ram cylinder, and more particularly to devices for releasable attachment to cylinder pistons for limiting the piston stroke.

BACKGROUND OF THE INVENTION

Ram cylinders are frequently used in applications where the stroke of the ram is used to raise, lower, or hold an implement in a selected position. In an agricultural example, a ram cylinder may be extended to lower a plow to a selected working depth. If the cylinder alone is used to maintain the working depth, continued stress on the plow during operation can stress the hydraulic circuit and can cause damage, or the hydraulics can leak and allow the plow to shift to a different working depth.

Various stroke limiting devices have been developed in the past that can be attached to the cylinder piston shaft for the purpose of limiting the return stroke of the piston. Upon retraction, the head of the piston will come into contact with the limiting device, which in turn will come into abutment with the cylinder body. The return stroke is thus limited by the axial thickness dimension of the stroke limiting device.

Known forms of stroke limiting devices include two clam shell clamp members that have a prescribed thickness dimension. The clamp members are typically held together by a wire or strap spring that yieldably holds the members closed on the piston shaft. The spring is typically attached to the clam clamp members within semi-annular grooves that are machined in the clamp members. Wire and strap springs have been used for this purpose.

A problem with the above forms of existing stroke limiting devices is that they are expensive to produce since machining is required to form the semi-annular grooves for receiving the spring ends. Even if no grooves are formed, there must be some provision made for connecting to the spring ends such as bolts, rivets or the like. Such fasteners add to the cost of the stroke limiting devices.

Prior stops also require special tooling to allow for use of the same spring configurations for cylinder stops of varying thicknesses. Additionally, because cylinder stops are available in both a variety of thickness and in different sizes to accommodate cylinders with piston shafts from, say one inch in diameter to two inches in diameter, different size springs have been required to secure the different size stops.

An object of the present invention is to provide a cylinder stop that is inexpensive to produce without requiring the use of special tooling to enable attachment of springs.

Another object is to provide such a cylinder stop that may be produced in various axial thicknesses dimensions but that make use of the same spring configuration, so a common spring shape needs to be used for different thickness stops for a prescribed piston size.

A further object is to provide a cylinder stop which may be produced in varied sizes to accommodate various size piston shafts, yet still having common spring end receiving sockets so the same spring may be also used with a variety of differently sized piston shafts.

A still further objective is to provide piston shaft gripping members that are extruded with spring end receiving sockets formed in the extrusion, to enable various thickness stop members to be cut from the extrusion with the spring receiving sockets formed integrally therewith.

The above and other objects and advantages may be understood from the following description.

BRIEF DESCRIPTION OF THE DRAWINGS

Preferred embodiments of the invention are described below with reference to the following accompanying drawings.

FIG. 3 is a side elevation of the preferred stop;

DETAILED DESCRIPTION OF THE PREFERRED EMBODIMENTS

Figure 2:
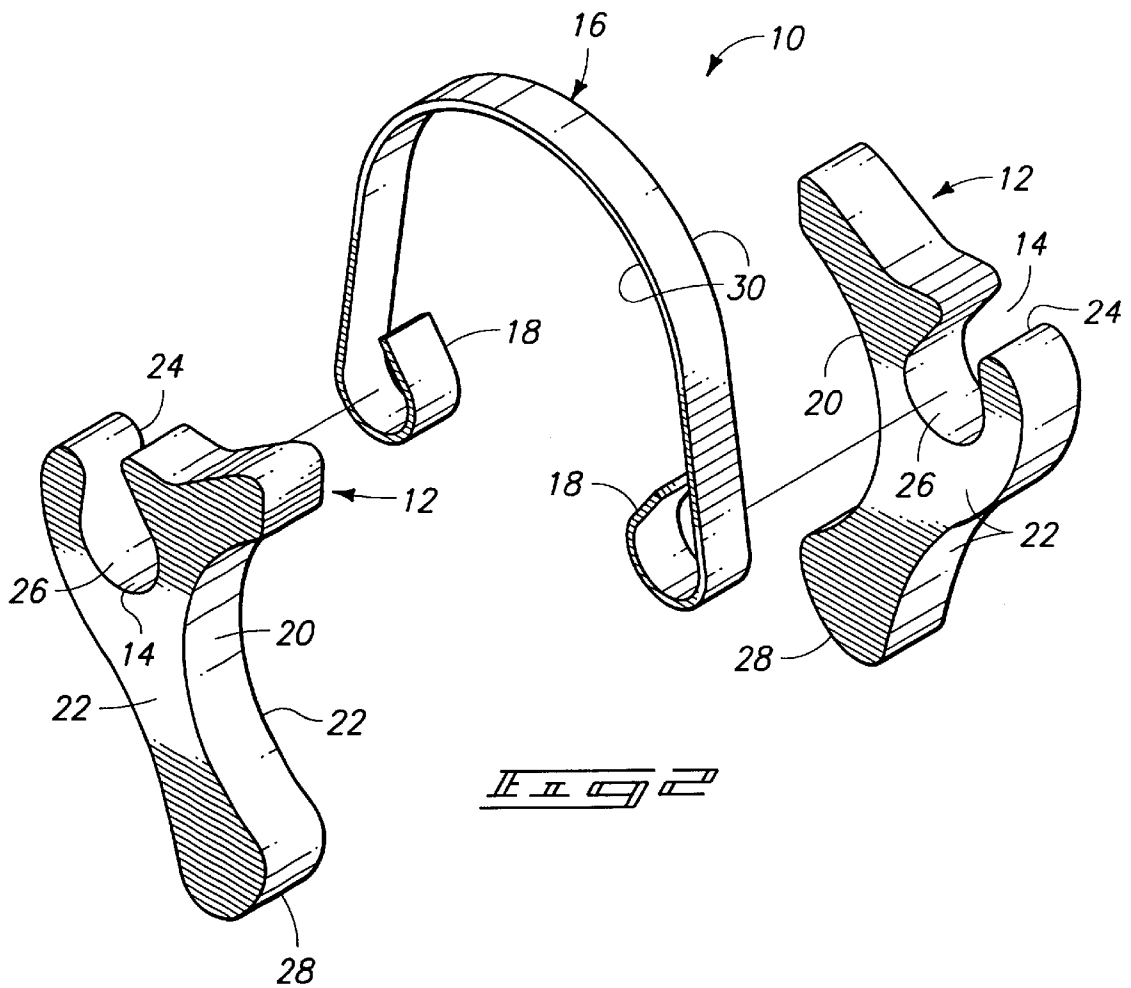
FIG. 2 is an exploded view illustrating the spring separated from the piston shaft gripping members.

This disclosure of the invention is submitted in furtherance of the constitutional purposes of the U.S. Patent Laws "to promote the progress of science and useful arts" (Article 1, Section 8).

Descriptions will first be given with respect to general aspects of the invention, followed by a more detailed description of preferred elements and relationships thereof.

In a first general aspect of the present invention, a ram cylinder piston stroke stop 10 provided in which a pair of opposed piston shaft gripping members 12. Each member 12 is formed in an extruded shape along an axis X with a thickness dimension "D" (FIG. 3) along the axis, and having an integral extruded axially open spring end receiving socket 14. A spring 16 is also provided, including opposed ends 18 that are engaged within the spring end receiving sockets 14.

In another aspect, the ram cylinder piston stroke stop 10 is comprised of a pair of the opposed piston shaft gripping members 12, each having the thickness dimension "D" along axis X and integral axially open spring end receiving socket 14. The spring 16 includes opposed ends 18 engaged within the spring end receiving sockets 14. The spring 16 is formed in a "U" shape with the ends 18 holding the piston shaft gripping members in laterally yieldable opposition with respect to the axis X.

In yet another aspect, the ram cylinder piston stroke stop 10 includes the pair of opposed piston shaft gripping members 12 with each piston shaft gripping member 12 including a piston shaft gripping surface 20. Each piston shaft gripping member 12 further defines the integral spring end receiving socket 14, formed along axis X. Each piston shaft gripping member also includes axially opposed end surfaces 22 that are spaced apart by thickness dimension "D". The spring end receiving sockets 14 open along the opposed end surfaces 22, and the spring 16 includes the opposed ends 18 that are shaped complementary to and axially received within the spring end receiving sockets 14 between the end surfaces 22. The spring is shaped in the "U" configuration with the opposed ends 18 holding the piston shaft gripping members 12 in substantial radial opposition.

Figure 1:
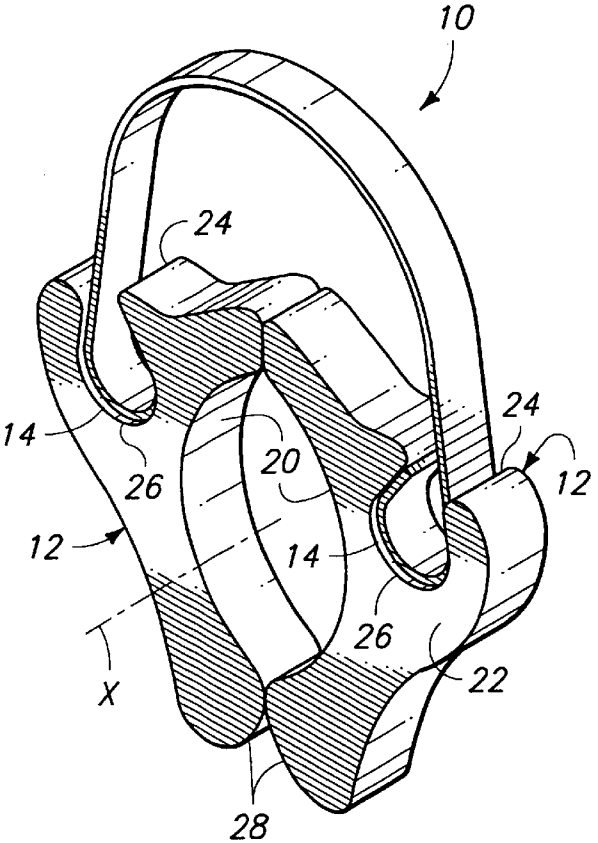
FIG. 1 is a perspective view of a first preferred form of the present cylinder stop.
Figure 4:
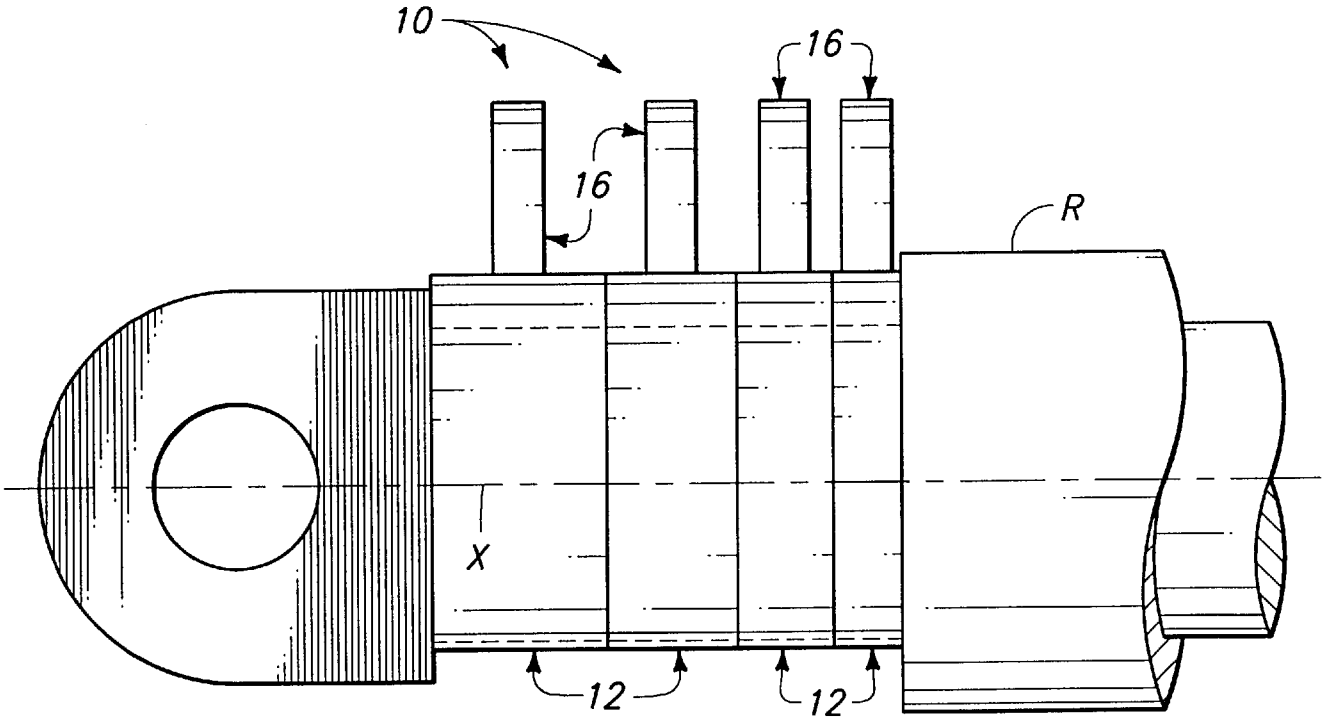
FIG. 4 is a side elevation view of several stops of varying thickness placed on a piston shaft.

Referring now in greater detail to the various elements, reference is first drawn to FIGS. 1 and 2. There, two piston shaft gripping members 12 are shown in radial opposition with respect to the axis X. The axis X is coaxial with the central shaft axis of a ram piston P when the piston stroke stop 10 is attached as shown in FIG. 4.

The preferred piston shaft gripping members 12 are identical, being cut or otherwise separated from a single elongated extrusion. The material is most preferably aluminum, since aluminum lends itself well to extrusion processes, is lightweight, and inexpensive. However, other materials may be used according to specific need. Brass, bronze, ceramics or even plastics may be for applications where compressive strength of the material is appropriate for the potential clamping forces exerted during use of an associated ram cylinder R.

Figure 8:
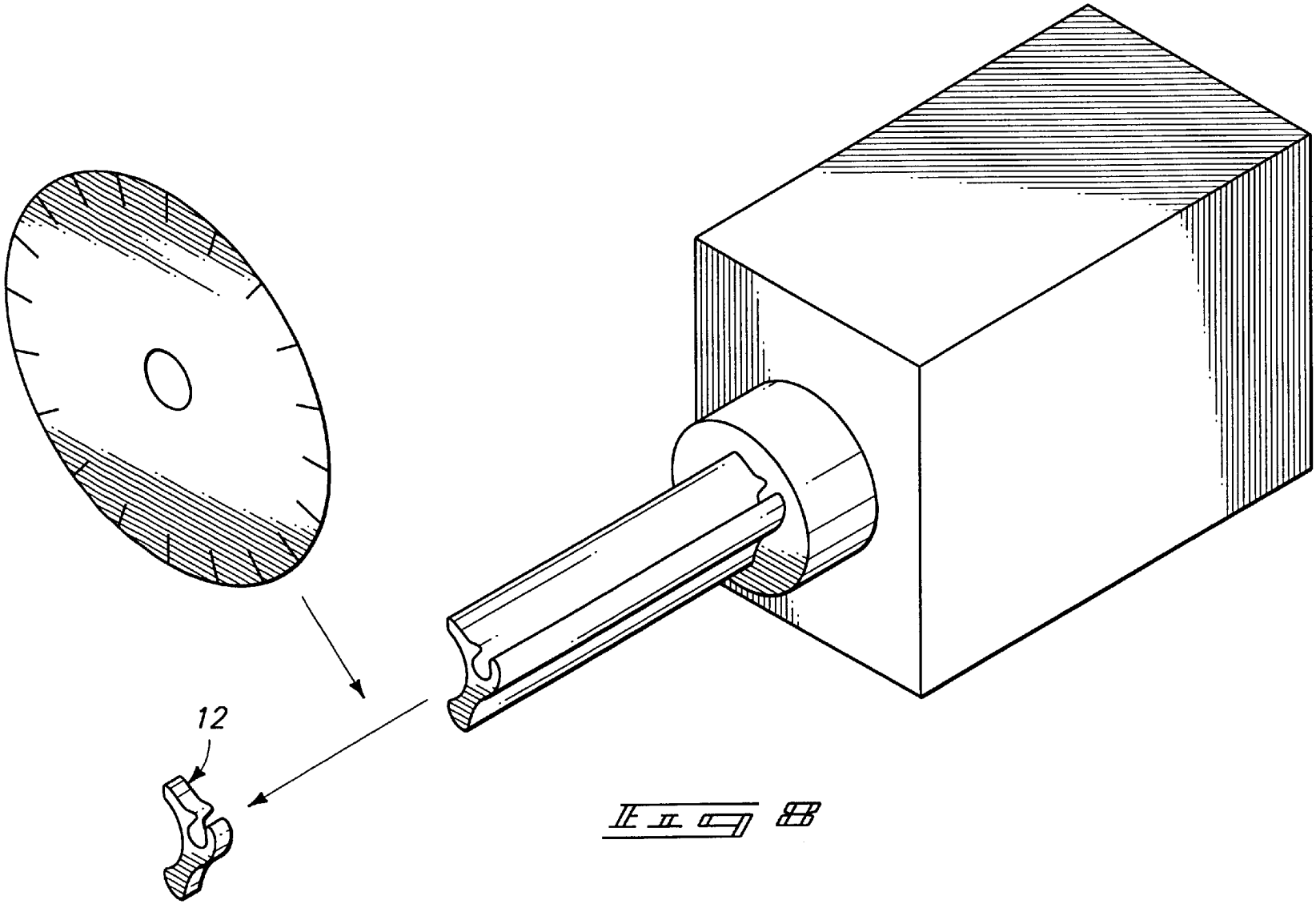
FIG. 8 is a diagrammatic view illustrating extrusion of a billet with a preferred cross-sectional shape for the present piston shaft gripping members.

An extruded gripping member 12 is formed as shown by FIG. 8 using conventional extrusion equipment. An elongated billet is formed with a cross-sectional shape that includes the piston shaft gripping surface 20 and the spring end receiving socket formed along the full billet length. Any reasonable length may be extruded, and used as stock for cutting or otherwise separating individual shorter gripping members 12 therefrom. For example, a stop 10, made up of two gripping members 12, each being an inch long may easily be produced by cutting two equal one inch long members 12 from the extruded stock; then fitting the members 12 to a spring 16. Smaller and larger thickness stops 10 may be produced in the same manner, by simply cutting the members 12 to the prescribed desired lengths.

With the spring end receiving socket formed integrally in the extrusion, both ends of the extruded socket shape will be open on both opposed end surfaces 22 of the gripping members. Thus, the formed spring ends 18 may be easily slipped into the sockets 14 from either end of the members.

The above-described manufacture of ram cylinder piston stops 10 may be contrasted with conventional gripping members for cylinder stops which must be cast individually and machined to form surfaces for mounting spring ends, or are machined from solid stock. Either of these manufacturing techniques is slower and very likely more costly than production of the preferred extruded piston gripping members 12 with the shaft gripping surfaces 20 and spring end receiving sockets 14 described herein.

Attention is drawn to FIG. 2 in which a stop 10 is shown in an exploded view. The spring end receiving sockets 14 are shown to open outwardly of the members 12 to allow placement of the similarly shaped spring ends 18. The sockets, are substantially identical since they are formed integrally with the extruded billet from which the members are cut.

Each socket 14 will preferably include an outward open end 24 and an enlarged, somewhat teardrop shaped closed bottom 26. The members may be produced with the socket parts 24 and 26 positioned similarly regardless of the gripping member size (compare FIGS. 6 and 7) so the same springs 16 may be used with different size gripping members 12. Thus, different size gripping members may be produced with substantially equal spacing between the sockets 14 (when the members are positioned in opposition as shown in FIG. 1), thereby allowing one spring size to be used for a variety of gripping member sizes.

For example, a pair of piston shaft gripping members 12 that are formed, say, for use on a one-inch diameter piston shaft can be made using the same spring configuration as a pair of members that are configured for use with, say, a two-inch diameter piston shaft. A significant manufacturing cost saving advantage is realized in the ability to produce different size gripping members without requiring production of different size springs.

The open spring end receiving sockets 14 may be formed in shapes other than the teardrop configuration shown. For example, a "J"-, "L"-, or "U"-shaped socket could be extruded in place of the illustrated socket shape. Other shapes capable of being formed by extrusion may also be used, so long as the shape allows for an interlocking relationship with appropriately formed spring ends.

Figure 7:
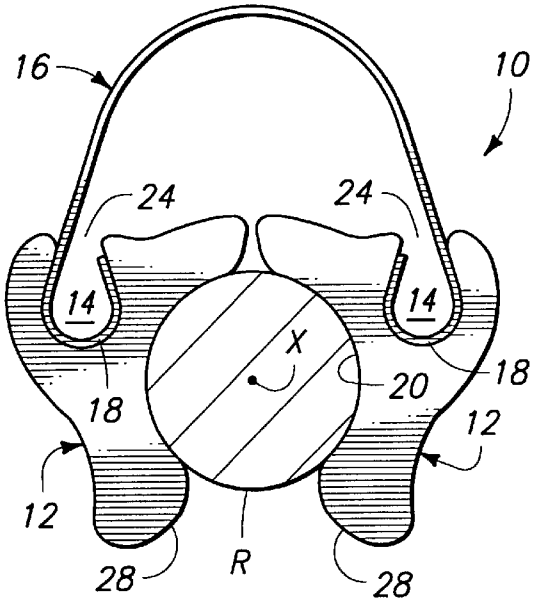
FIG. 7 is an end view of a piston gripping member for use with a piston shaft of a different size than that illustrated in FIG. 6, yet with the same spring configuration.
Figure 6:
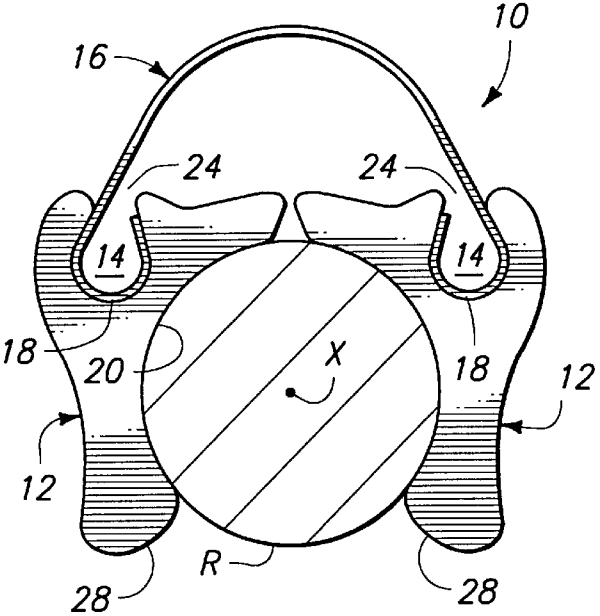
FIG. 6 is an end view of the preferred stop with piston gripping members for use with a piston shaft of a prescribed size.
Figure 5:
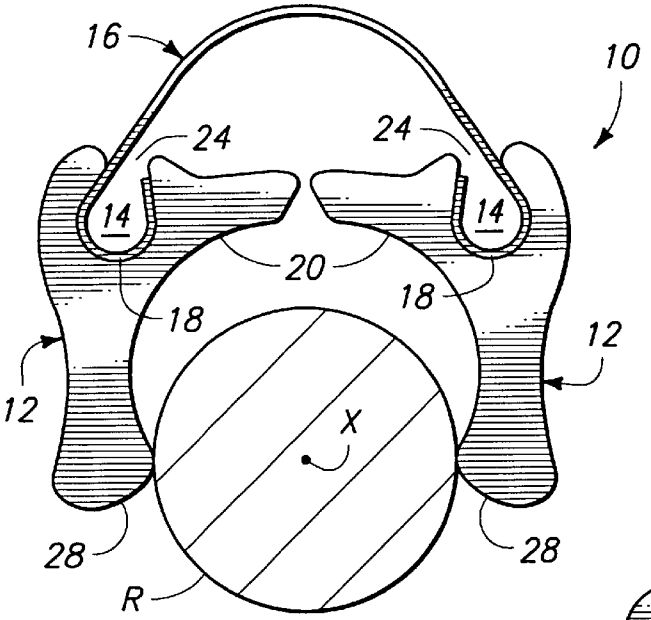

The piston shaft gripping surfaces 20 lead arcuately outwardly to flared tips 28 which are spaced in opposition (with respect to the axis X) to the spring end receiving sockets. The tips 28 are preferably flared as shown to slide against and cam the members 12 apart when the stop is pressed onto a piston shaft. Thus, there will may be no need to pry the members apart to mount the stop on an appropriately sized piston shaft. Once in place, the arcuate concave gripping surfaces 20 will conform intimately with the transverse curvature of the piston shaft, as shown by FIGS. 6 and 7.

Referring now to the spring 16, reference is made specifically to FIG. 2, which shows the preferred "U"-shaped flat strap with side edges 30 spaced apart by an axial width dimension that is no greater than the axial thickness dimension between the opposed end surfaces 22 of the piston shaft gripping members 12.

The preferred axial width dimension of the spring is less than the axial width of the members 12 so the spring will not be engaged and damaged by the ram cylinder when the piston is retracted. Further, the strap configuration is preferred because the stops are typically placed and removed by hand. Thus, although a wire type spring could be used, the strap is preferred because the larger surface area is more easily grasped and will not dig into the user's fingers as would wire.

Ends 18 of the spring 16 are preferably formed to mate in somewhat of an interference type fit with the sockets 14 of opposed piston shaft gripping members 14. The ends 18 may be shaped in the same tear drop configuration as the sockets 14, but slightly larger. Being formed of spring material, the shaped ends may be mechanically compressed, then slid into the sockets 14. Once the spring is in a desired position, with spring side edges 30 situated axially between the axially spaced end surfaces 22 of the gripping members 12, the ends are released to expand and firmly engage the walls of the sockets.

Figure 5:
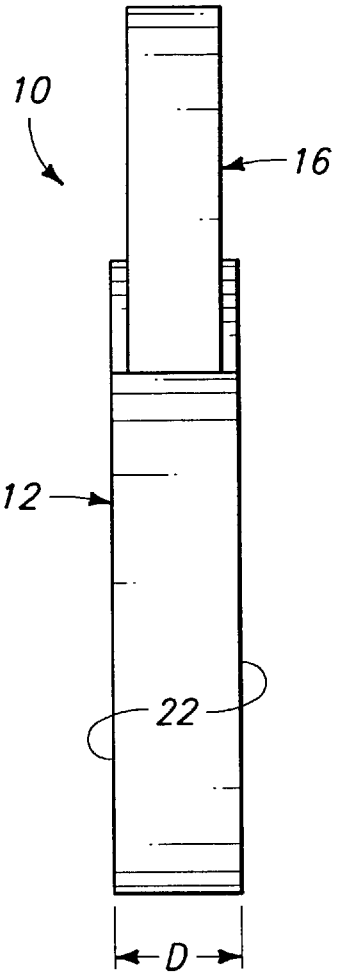
FIG. 5 is a sectional view taken through a piston shaft with the present cylinder stop in an open position while being attached to or removed from the piston shaft.

The distance between legs of the "U"-shaped spring is determined so that when the spring is mounted to the smallest sized gripping members 12 and in a relaxed state (FIG. 1), the members are yieldably held together, either touching one another or in close proximity. When the same size spring is mounted to larger gripping members, with similarly spaced and positioned sockets 14, the larger gripping members will normally be held in a similar closed condition. In either situation, the spring is sufficiently yieldable (FIG. 5) to allow the stop to be easily fitted onto and removed from a ram piston shaft. This is due to the "U" shape of the spring 16, the position of the sockets (to one side of the axis X) and the ability of the legs to flex apart.

It is pointed out that the piston shaft gripping members can be produced in various axial thickness dimensions. In fact, it is typically desirable for a user to have a variety of different thickness stops available for different cylinder settings. Thus, as shown in FIG. 8, the extruded billet may be selectively cut to form individual gripping members 12 of various axial dimensions. For example, a set of stops may be produced with members 12 having axial dimensions of 0.5, 0.75, 1.0, 1.25, 1.5 inches and so on. Various combinations of the stops can then be used for various stroke settings. For example, a piston stroke setting of 3 inches is desired. The user may select any combination of stops with axial dimensions that add up to total 3 inches (say three 1-inch stops, or two 1.5-inch stops).

If members 12 are made to considerable lengths, several springs may be mounted within the sockets 14 to avoid racking or twisting of the members 12. For example, a stop measuring 3 inches between end surfaces 22 might make use of two springs, each spaced inwardly from an adjacent end surface 22. Of course, springs of different axial dimensions could be produced to match the axial dimensions of the members, but it is preferred that a single axial spring size (sufficient to fit the smallest axial member dimension) be used, and that multiples of the same-size springs be used when needed.

Given the above description, operation of the invention may be easily understood. It is assumed that the stops will be assembled with springs by the manufacturer, so the user need only select the desired stops for placement, then place the stops on the piston shaft between the body of the cylinder and the head or clevis at the shaft end.

Assume a cylinder with a two-inch diameter piston is to be set at a 3-inch stroke. The user will extend the cylinder just beyond 3 inches, then fit any number of the stops onto the shaft such that the total axial thickness of the stops along the piston shaft will be 3 inches. Now the cylinder may be retracted and the stops will automatically stop the stroke at 3 inches.

The stops 10 are mounted to the piston shaft simply by separating the members 12 apart and gliding the members onto the piston shaft. Natural tension of the spring will cause the members 12 to close on the shaft with the gripping surfaces firmly engaging the piston shaft.

The stops may be removed simply by gripping the springs and pulling laterally outward with respect to the piston shaft. The spring size, shape, and configuration with the gripping members 12 may allow the stop to be opened with one hand. Upon application of sufficient pulling force, the spring will yield and allow the members 12 to separate and the stop will easily slide off the piston shaft.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A ram cylinder piston stroke stop, comprising:

a pair of opposed piston shaft gripping members each formed in an extruded shape along an axis with a thickness dimension along the axis, and having an integral extruded axially open spring end receiving socket; and a spring including opposed ends engaged within the spring end receiving sockets.

2. A ram cylinder piston stroke stop as defined by claim 1 wherein the piston shaft gripping members are formed of extruded aluminum.

3. A ram cylinder piston stroke stop as defined by claim 1 wherein the spring is formed as a flat strap.

4. A ram cylinder piston stroke stop as defined by claim 1 wherein the spring is formed as a flat strap and wherein the ends are bent to conform to the spring receiving sockets.

5. A ram cylinder piston stroke stop as defined by claim 1 wherein the spring is formed as a flat strap and wherein the ends are bent to conform to the spring receiving sockets, and wherein the sockets are open on axially opposed end surfaces of the piston shaft gripping members.

6. A ram cylinder piston stroke stop, comprising:

a pair of opposed piston shaft gripping members each having a thickness dimension along an axis and an integral axially open spring end receiving socket;

a spring including opposed ends engaged within the spring end receiving sockets; and wherein the spring is formed in a "U" shape with the ends holding the piston shaft gripping members in laterally yieldable opposition with respect to said axis.

7. A ram cylinder piston stroke stop as defined by claim 6, wherein the pair of opposed piston shaft gripping members are substantially identical to one another.

8. A ram cylinder piston stroke stop as defined by claim 6, wherein the spring is comprised of a flat strap spring with the opposed ends bent to be releasably received axially within the respective spring end receiving sockets.

9. A ram cylinder piston stroke stop as defined by claim 6 wherein the piston shaft gripping members are extruded.

10. A ram cylinder piston stroke stop as defined by claim 6 wherein the piston shaft gripping members are formed of extruded aluminum.

11. A ram cylinder piston stroke stop, comprising:

a pair of opposed piston shaft gripping members;

each piston shaft gripping member including a piston shaft gripping surface;

each piston shaft gripping member further defining an integral spring end receiving socket formed along an axis;

each piston shaft gripping member further including axially opposed end surfaces that are spaced apart by a thickness dimension;

wherein the spring end receiving sockets open along said opposed end surfaces;

a spring including opposed ends shaped complimentary to and axially received within the spring end receiving sockets between said end surfaces;

wherein the spring is shaped in a "U" configuration with the opposed ends holding the piston shaft gripping members in substantial radial opposition.

12. A ram cylinder piston stroke stop as defined by claim 11, wherein the spring is formed of a flat strap with side edges spaced apart by a distance no greater than the thickness dimension between the opposed end surfaces of the piston shaft gripping members.

13. A ram cylinder piston stroke stop as defined by claim 11, wherein the spring end receiving sockets are open on both opposed end surfaces of each piston shaft gripping member.

14. A ram cylinder piston stroke stop as defined by claim 11, wherein the pair of opposed piston shaft gripping members are substantially identical to one another.

15. A ram cylinder piston stroke stop as defined by claim 11, wherein the pair of opposed piston shaft gripping members and spring end receiving sockets are formed by extrusion.

16. A ram cylinder piston stroke stop as defined by claim 11, wherein the piston shaft gripping members include remote tips that are spaced to one side of the axis opposite to the spring end receiving sockets.

* * * * *